United States Patent [19]

Kirkland

[11] Patent Number: 4,970,702

[45] Date of Patent: Nov. 13, 1990

[54] ELECTRICAL CONDUCTOR DETECTING DEVICE

[75] Inventor: James L. Kirkland, Panama City, Fla.

[73] Assignee: The United States of America as represented by the Secretary of the Navy, Washington, D.C.

[21] Appl. No.: 783,455

[22] Filed: Dec. 5, 1968

[51] Int. Cl.[5] ..... F42B 22/42

[52] U.S. Cl. ..... 367/131; 102/402

[58] Field of Search ..... 340/3 T, 4, 4 E, 5 D; 114/221, 221.1, 235, 235.2, 245, 253, 221 A; 367/131, 130, 19, 17; 405/156; 102/402

[56] References Cited

U.S. PATENT DOCUMENTS 3,020,871 2/1962 Temple et al. ..... 114/221 A 3,082,731 3/1963 Cousteau et al. ..... 114/244

3,108,246 10/1963 Jones ..... 114/253

4,004,540 1/1977 Higgins et al. ..... 114/221 A

*Primary Examiner*—Nelson Moskowitz

*Assistant Examiner*—Daniel T. Pihulic

*Attorney, Agent, or Firm*—Sol Sheinbein; John Becker; Harvey David

[57] ABSTRACT

A sweep device for river mines of the command type is described. The device employs two spaced, parallel blades which support the sweep device on the bottom of the river as it is towed therealong. The blades constitute laminated cutting elements which provide a signal of the presence of a command wire as it is severed on contact, as well as serve as electrodes for supplying an electric signal to sweep the mine. An electrical circuit is also described to process the signals from the blades, so as to distinguish between small metallic debris and metallic bodies bridging the two blades.

10 Claims, 3 Drawing Sheets

ELECTRICAL CONDUCTOR DETECTING DEVICE

The invention described herein may be manufactured and used by or for the Government of the United States of America for governmental purposes without the payment of any royalties thereon or therefor.

This invention pertains to a countermeasure device for use against command type mines in rivers and harbors. This type of mine is used extensively in narrow channel streams to thwart movement of personnel and supplies. Since this type of mine is small, simple to operate, and easily transported and installed, it is a particularly effective weapon for use by espionage teams in occupied territory where control of the watercourses is presumed to be complete. The effect of this type of mine can be considerable in areas where seasonal rainfall makes other forms of surface transportation difficult for several weeks at a time.

This type of mine, in its basic form, comprises an explosive charge in a buoyant housing. The charge is moored in place in the watercourse and is fused electrically. Personnel operating the mine observe the watercourse from a concealed riparian control point near the mined area, and fire the mine when a ship is within range of the device.

An effective countermeasure in the past has been to sever the command circuit wire by dragging suitable heavy grapnels along the bottom of the channel. This grapnel sweep renders the mines ineffective, it may be performed rapidly and inexpensively, but it does not disable the mines in such a fashion as to prevent their being reconnected. However, to completely disable the mine, the mine must be located and removed by a demolition team, or must be ignited harmlessly by the sweep mechanism.

The locating of command wires at the time of severing has been accomplished by use of a multiblade cutting device whose blades constitute the electrodes of a galvanic cell. In using such a system, the output of the cell is monitored, either manually or by electronic equipment. Upon receipt of a signal indicating a metallic contact, the location is marked for subsequent investigation by swimmer-diver personnel. The removal of the mine then proceeds in accordance with standard ordinance disposal techniques.

Heretofore, to ignite the mine in conjunction with severing the command wire, a special sweep device was employed. This sweep device employs a plurality of electrically conductive blades, and is drug along the bottom to cut the command wire. A detection and power supply circuit within the tow vessel delivers a high voltage pulse to the blades, and thereby to the mine, upon contact with the command wire. The high voltage pulse is effective to detonate the mine.

The galvanic detection sweep and electrical detonation sweeps of the prior art suffer from actuation by metallic debris on the bottom. The false indications and actuations require the sweep vessel to progress along the channel rather slowly. Further, each of the systems requires different sweep gear be used, thereby necessitating additional time being spent in streaming and recovering the sweep gear when it is desired to change from one sweep system to another.

Accordingly, it is an object of this invention to provide an improved sweep gear for use as a countermeasure against command type mines.

A more specific object of this invention is the provision of a towed sweep vehicle having utility in a variety of sweep techniques.

A further object of this invention is the provision of a system for electrically sweeping command mines which minimize the number of false actuations.

Another object of this invention is the provision of a novel construction of a wire-cutting blade structure for use in command mine sweeping applications.

A further object of this invention is the provision of a sled-like underwater vehicle having a plurality of wire incising runners.

Other objects and many of the attendant advantages will be readily appreciated as the subject invention becomes better understood by reference to the following detailed description, when considered in conjunction with the accompanying drawings wherein.

Figure 1:
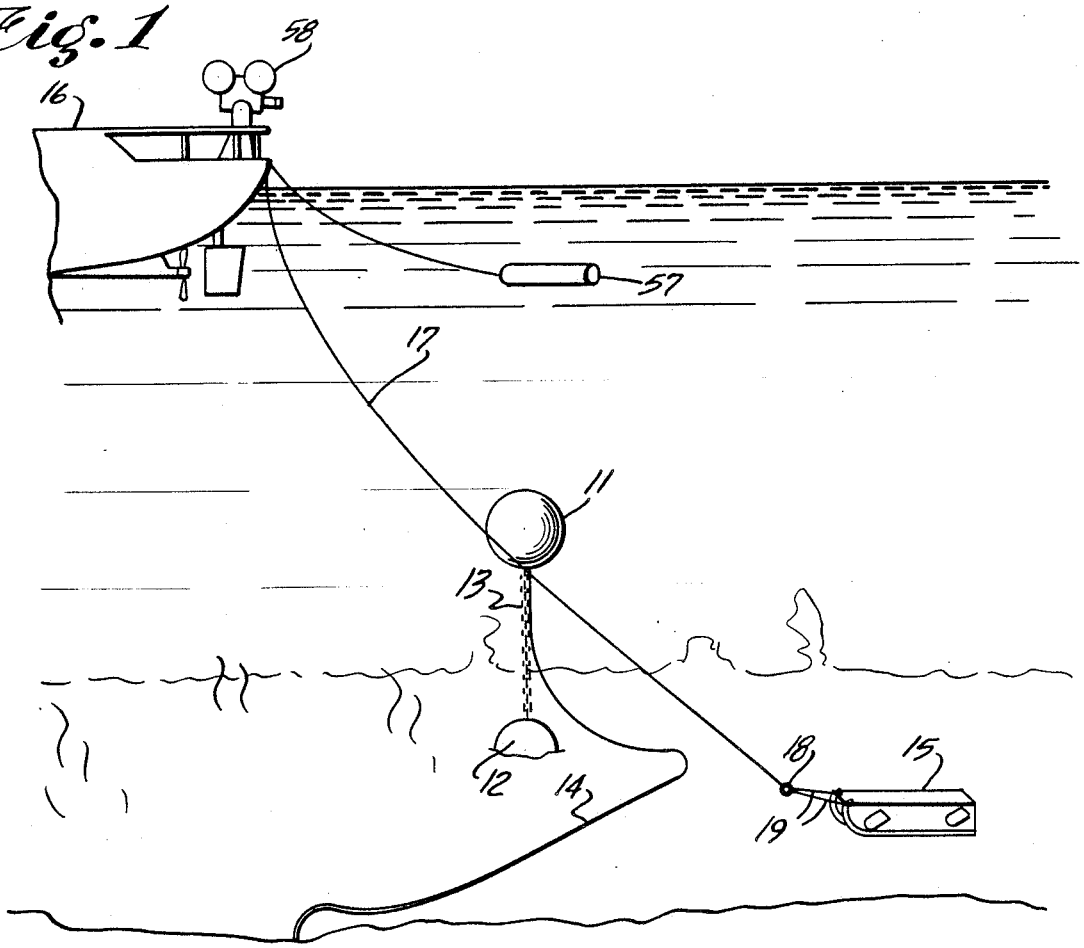
FIG. 1 is an illustration showing the device of the invention in use.

Referring to FIG. 1, there is shown a command mine comprising an explosive charge 11 moored to an anchor 12 by a chain 13. An electrical command wire 14 connects a detonation device, not shown, located within explosive charge 11 to a remote command point, not shown. Command wire 14 is, typically, a two conductor wire which is made sufficiently waterproof by the electrical insulation. However, it should be borne in mind, the illustrated mine installation is exemplary only, and, in fact, a wide variation exists between installations, as a result of using locally available materials in the construction of the mine.

A sled-like sweep vehicle 15 is also shown in FIG. 1. The sweep vehicle 15 is propelled along a predetermined course by a suitable tow vessel 16. Tow vessel 16 is shown as a surface watercraft, but other tractor vehicles, including air-cushion vehicles, as well as fixed or rotary wing aircraft, may be used, if desired. Attachment between the tow vessel 16 and the sweep vehicle is made with suitable electrical tow line 17. A junction device 18 provides a mechanical and electrical connection from tow line 17 to sweep vehicle 15 via a towing bridle 19. Such lines are conventional in the minesweeping and oceanographic instrumentation arts, and provide both mechanical and electrical connection. A variety of prior art tow line systems are available and serve the purposes of this invention with equal efficiency; therefore, the illustrated arrangement should only be regarded as illustrative, and subject to modification by those proficient in these arts.

Figure 2:
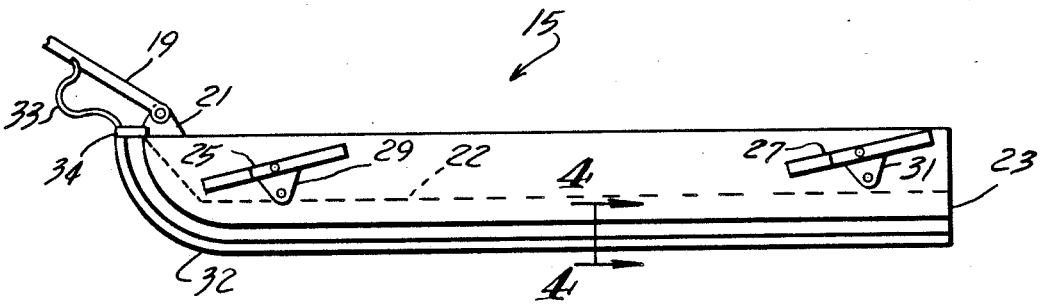
FIGS. 2 and 3 are views of the sweep device of the invention.
Figure 3:
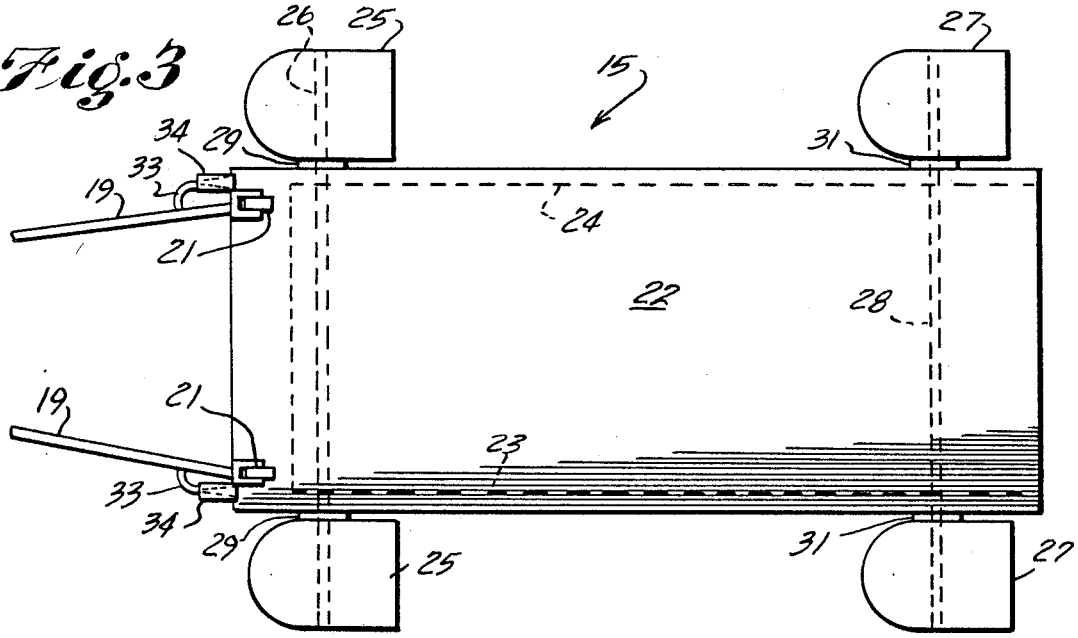

Referring to FIGS. 2 and 3, sweep vehicle 15 is seen to be attached to towing bridle 19 at two towing bits 21. A center section 22 mounts towing bits 21, a port runner 23 and a starboard runner 24. Runners 23 and 24 extent downwardly from center section 22 at the respective extremities thereof. Forward depressors 25 are mounted on either side of sweep vehicle 15 for independent angular adjustment about a transversely extending axle 26. A similar set of depressors 27 are mounted at either side of the aft portion of sweep vehicle 15 on a transversely extending axle 28.

Depressors 25 and 27 produce a hydrodynamically derived, downwardly directed force on sweep vehicle 15, as it is moved along the bottom. Said force counters any lift developed by the movement of sweep vehicle 15 through the water. The depressors are secured in a desired angular position which is dependent upon the weight of sweep vehicle 15, the speed at which it will be towed, and the physical characteristics of tow line 17. To affect this position adjustment, depressors 25 and 27 have downwardly extending tab portions 29 and 31, respectively, which are secured to runners 23 and 24 by suitable fastening means.

Center section 22 is made from steel or other material capable of imparting a structural rigidity to sweep vehicle 15. If desired, the major structural portions of sweep vehicle 15 may be constructed as a lightweight glass fibre shell. In such an embodiment, a large number may be conveniently nested together and shipped abroad. At their destinations, the units are assembled by inserting axles 26 and 28 and towing bits 21 and filling with a cementitious material in a semi-solid condition which is allowed to harden into a rigid monolithic structure. In hardening, cementitious material envelopes irregularities on axles 26 and 28 and towing bits 21, such that they are secured in place. Routine techniques in the molding arts, such as mold vibration to insure uniform filling and inserting reinforcing members, are employed when this construction is employed. Likewise, conventional curing techniques may be employed to insure structural integrity.

In some instances, the weight provided by the cementitious makes the use of one or both sets of depressors 25 or 27 unnecessary, and, accordingly, they may be omitted, if desired. Also, sweep vehicle 15 may carry other instrumentation gear or sweep gear. In such instances, the gear or the mounting therefor may be inserted into the mold-hull form at the time of filling or prior to solidification.

The lowermost extremity of runners 23 and 24 carry sharpened blades 32. Blades 32 extend along the horizontal portions of runners 23 and 24 and continue around the forward curved portions to terminate at the upper surface of sweep vehicle 15. As will be explained, blades 32 are electrically conducting, and operative connection thereto is provided by electrical cables 33 and terminating connectors 34. Towing bridle 19 may carry electrical cables 33 internally, as shown, or externally, if desired. Similarly, the particular construction of connector 34 is left to the choice of the builder, and may be selected from the many satisfactory embodiments well known in the art.

Figure 4:
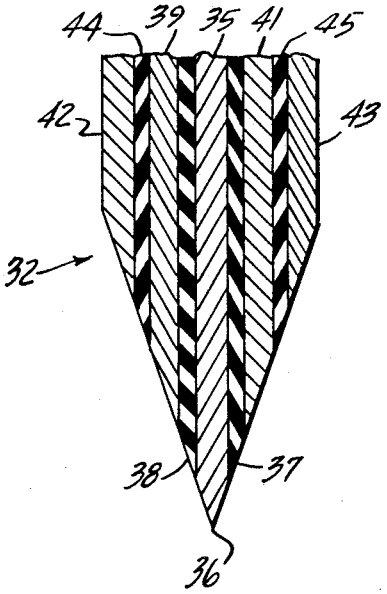
FIG. 4 is a sectional view of one of the blade runners taken along line 4—4 of FIG. 2.

A more complete understanding of the construction of the blades 32 may be obtained by reference to FIG. 4, which shows a section of blade 32 taken along line 4—4 of FIG. 2. One sees that blade 32 has a metallic center element 35 which terminates in a sharpened edge 36. Insulator layers 37 and 38 are placed on either side of center element 35. Parallel metallic elements 39 and 41 lie alongside center element 35 and are separated therefrom by insulating layers 37 and 38. Additional parallel metallic members 42 and 43 lie alongside the aforementioned metallic members 39 and 41 and are separated therefrom by insulating layers 44 and 45. The material from which metallic members 35, 39, 41, 42 and 43 are made is chosen for its electrical conduction properties and its resistance to the abrasive and corrosive action of the underwater environment to which the subject device is exposed. Commercially available alloys of stainless steel have proven satisfactory in this service. Insulating layers 37, 38, 44, and 45 may be made of a variety of plastic resins or of ceramic material, in accordance with the preference of the constructor.

As may be appreciated, a variety of electrical circuit connections may be made to the five conducting elements shown. In practice, three conductors are connected to each blade 32: one to center element 35, one to elements 39 and 41, and one to elements 42 and 43. Since blades 31 are connected in three element circuits, a three member blade could be fabricated, if desired. However, in some applications the exposure of only the faces of mutually insulating elements is desired, and for reasons arising from this consideration, together with considerations of convenience of construction, the five conducting element blade is preferred. For galvanic detection, one element pair may be positioned to prevent contact with command wires, thereby permitting it to serve as a reference electrode.

The thickness of the various elements is a matter of design choice. However, for some applications, such as galvanic detection, it is a convenience if the thicknesses of the mutually insulated members is chosen such that approximately equal areas of element face surface are exposed. In general, the approximate thickness of the blade 31 is 1.5 cm. This thickness is such as to provide sufficient mechanical strength and still permit an edge angle which will allow contact of a plurality of elements by a command wire, as will be explained herein.

When sweep vehicle 15 contacts a command wire 14, the weight of the low vehicle, together with the downward force supplied by depressors 25 and 27, forces the command wire 14 into the bottom, and, in so doing, forces the sharpened edges of blades 32 into the insulation and conductors thereof. The command wire 14 bends as it is forced into the bottom, and, thereby, presents a curved surface to the direction of cutting advance of blade 32. A tangential cutting action results from this relative positioning, and the conductors in command wire 14 make a closed circuit connection across the various elements of each blade 32 as it passes along and through the command wire. This type contact has proven more reliable than that obtained from one blade to the other, possibly because the movement of sweep vehicle 15 disturbs the position of the cutout segment.

It has been discovered that the complete severing of command wire 14 occurs during the initial period of contact. However, the bottom material holds the severed ends of the command wire 14 outboard of sweep vehicle 15 in position, so as to contact with the blade 32 as the sweep vehicle 15 moves it therealong. The length of blade 31 is, therefor, determined by the desired contact time and the towing speed. A wire contact time of 0.5 seconds has been found to be sufficient for satisfactory operation of all the types of sweeps contemplated. This time, taken together with the normal towing velocity, results in an effective blade length of approximately 1.5 meters.

Figure 5:
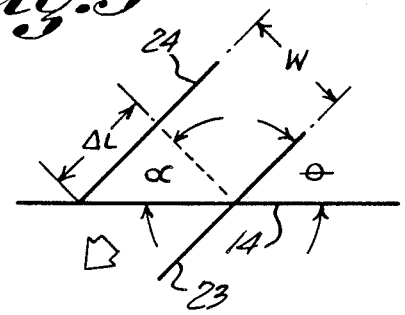
FIG. 5 is a diagram showing the various parameters of design useful in establishing dimensions for the device of the invention.

To the above figure, must be added an amount corresponding to the amount one blade precedes the other in reaching a command wire 14 angularly disposed to the course of sweep vehicle 15. Referring to FIG. 5, this length is identified as $\Delta L$ on the diagram showing the position of runners 23 and 24 and command wire 14. As shown, port runner 23 has contacted and passed over a command wire 14 disposed at an angle $\theta$ to the direction of tow, shown by the arrow. From simple trigonometric relationships, it is apparent that the length to be added to the effective length is given by:

$$\Delta L = W \tan \alpha,$$

where $\Delta L$ is the length to be added;

W is the spacing between blades; and $\alpha$ is the complementary angle to angle $\theta$, the angle of command wire 14 to the course of sweep vehicle 15.

Practical considerations have established a maximum blade or runner separation of 1.5 meters. This figure is somewhat arbitrary and is dependent upon the average size of metallic debris found in the area of operation of the device as well as such factors as structural integrity and ease of handling. It is apparent that as the angle $\theta$ decreases, that is, as the command wire parallels the course of sweep vehicle 15, the blade length becomes excessive. As a practical matter, the angle of 45° is considered as limiting, and the added length, $\Delta L$, is, therefor, the same as the blade separation. It should be noted that the sweep vehicle 15 will sever command wires having smaller angles of interception, but, because both blades 32 may not contact the conductor simultaneously, other sweep and indication gear associated with sweep vehicle 15 may have their efficiency impaired in these circumstances.

The relative density of metallic debris in the channels of watercourses where the device is used is not so high as to give a high percentage of false readings. That is, in most cases, when the two blade assemblies experience simultaneous metallic contact, a single metallic conducting body has bridged the two blade assemblies. Since the sweeping operation is performed repeatedly in the same channel, the few pieces of debris long enough to give false indications are soon all discovered and either removed or charted.

Figure 6:
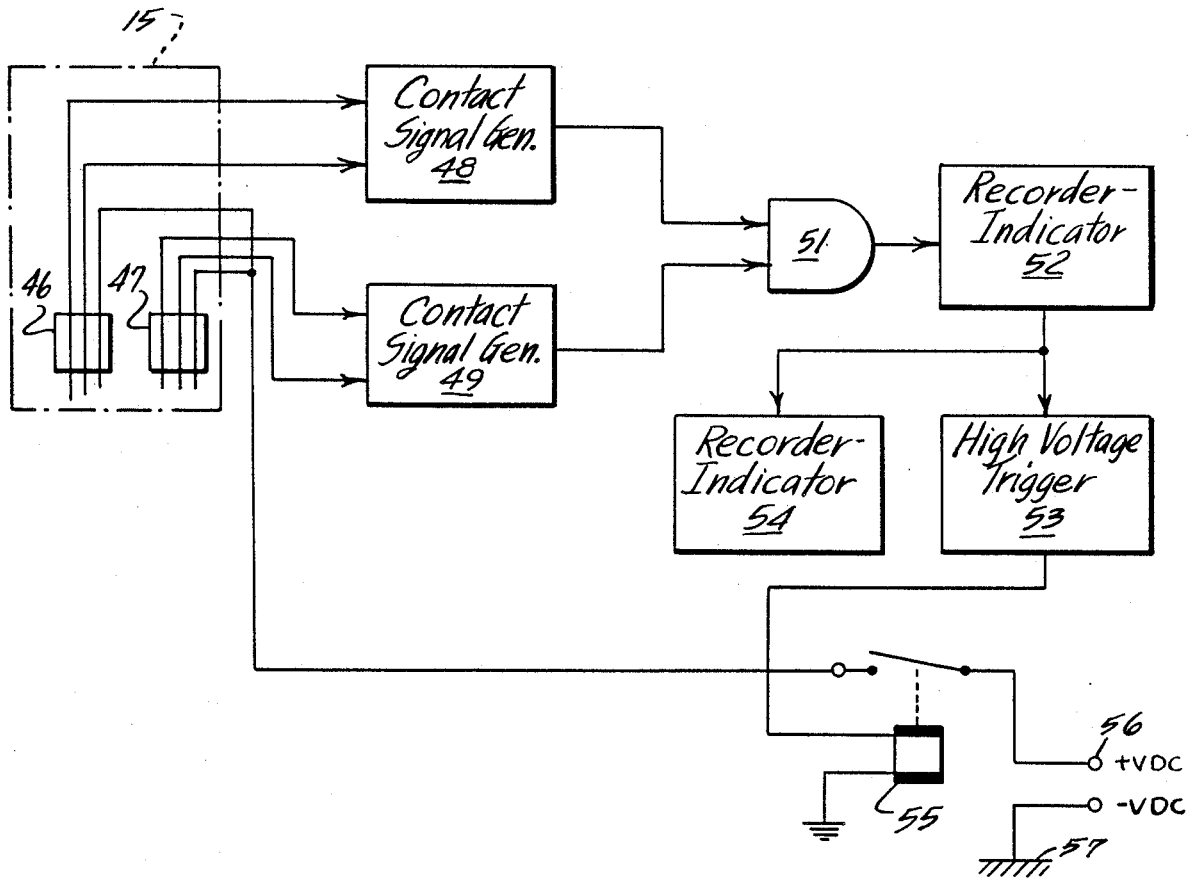
FIG. 6 is a schematic showing of an electrical circuit using the sweep device of the invention for electrically sweeping command mines.

Referring to FIG. 6, a schematic illustration of an electronic circuit to be used in conjunction with sweep vehicle 15, blade assemblies 46 and 47 are connected to contact signal generators 48 and 49 respectively. Blade assemblies 46 and 47 are shown schematically as being three element structures, but it should be understood that they are of the same construction as blade 31, described supra. Contact signal generators 48 and 49 may be of any suitable construction to produce an output when their associated blade assembly is in contact with a conductor of command wire 14. In the case of galvanic type detection, the contact signal generators 48 and 49 may be high gain DC amplifiers, or, in the case of a shorting type detection, they may be electronic switching circuits.

The output signals from contact signal generators 48 and 49 are fed to an AND circuit 51. AND circuit 51 is of conventional construction and has its circuit parameters chosen so as to be compatible with the other circuit components of the system, as will be understood by those versed in the electronic design arts. The output of AND circuit 51 corresponds to a simultaneous input from contact signal generators 48 and 49, and hence, to simultaneous contact of blade assemblies 46 and 47 with a metallic object, and is fed to a coincidence timer circuit 52.

The coincidence timer 52 develops a signal proportional to the length of time the output of AND circuit 51 is applied to it, and therefore, may be considered as a time varying signal generator. It may take the form, for example, of an increasing voltage function generator or a sweep frequency oscillator. The output of the coincidence timer circuit 52 is supplied, via appropriate circuitry, to a high voltage trigger circuit 53 and a recorder-indicator device 54.

A relay 55 is operated by high voltage trigger circuit 53 to connect a high DC voltage supplied to terminal 56 to the blade assemblies 46 and 47. This high potential may originate from any convenience power source, and, in the prior art systems providing electrical sweeps, is stored in a capacitor bank. The detonation of the mine is caused by the high voltage creating a leakage current from the detonator to the mine case, or by the high voltage being applied through the detonator and back into the water via the severed command wire. A return electrode 57, FIG. 1, is towed by a conducting cable so as to be immersed in the ambient water, and thereby complete the high voltage circuit by water conduction, so as to establish this detonating current path. It has been found that a high voltage in the range of 20–50 KV is sufficient to overcome transmission losses and still have high enough magnitude to cause detonation of electrical firing mechanisms.

High voltage trigger circuit 53 is a threshold type circuit designed to produce an output when the coincidence timer has produced a predetermined signal corresponding to blade assemblies 46 and 47 maintaining simultaneous contact with a command wire. For example, coincidence timer circuit 52 may generate a ramp voltage varying linearly from one to two volts in 0.3 seconds, and high voltage trigger circuit 53 may be a biased solid state switch set to trigger at 1.5 volts, e.g., 0.15 seconds after contact of the second of blade assemblies 46 and 47. Should coincidence timer 52 be a sweep generator, a resonant threshold switch could be employed for high voltage trigger 53. It is obvious that coincidence timer 52 and high voltage trigger 53 may employ a variety of circuit types, and, accordingly, may be selected from the prior art circuit configuration by a person versed in the electronic arts.

Likewise, a variety of available devices may be used for recorder-indicator 54. A recorder employing a moving strip and recording pen is particularly satisfactory. With such a device, the movement of the strip may be coordinated with the movement of the tow vessel 16, a distinct advantage for relocating the points where command wires were contacted. Other type indicator and recorder devices have proven satisfactory in preliminary studies, and may be employed in the system if desired. For example, in addition to a printing recorder-indicator 54, or in place thereof, a sound motion picture camera 58, FIG. 1, may be employed. In such an arrangement the camera photographs the shore features while a beeper device records a sound signal on the sound track when a contact with a command wire is made. The film may be replayed to locate the fixed shore points corresponding to the command wire contacts, as in the case of the printing recorder. However, the film record provides additional information which may assist counterespionage personnel in recognizing transient vehicles, such as boats and trucks, where mine control personnel may be concealed.

The foregoing description taken together with the appended claims constitute a disclosure such as to enable a person skilled in the electronic and minesweeping arts and having the benefit of the teaching contained therein to make and use the invention. Further, the structure herein described meets the objects of invention, and generally constitutes a meritorious advance in the art unobvious to such a skilled worker not having the benefit of the teachings contained herein.

What is claimed is:

1. A minesweeping system for locating and sweeping marine mines of the type controlled by command wires connected thereto comprising:

tractor vehicle means;

towing means attached to said tractor vehicle for towing suitable gear astern of said tractor vehicle;

sweep vehicle means attached at the forward end thereof to said towing means for towing thereby;

runner means disposed adjacent to the lateral extremities of said sweep vehicle extending downwardly therefrom and curved upwardly at the forward edge thereof to support said sweep vehicle for sliding movement thereon;

metallic blade means attached to said runner means and extending along the full length thereof for severing said command wires encountered by said sweep vehicle, as it is towed by said tractor vehicle means;

circuit means mounted within said tractor vehicle means for generating predetermined electrical signals in response to contact between said metallic blade means and said command wires; p1 electrical conductor means carried by said towing means and electrically connected between said metallic blade means and said circuit means for transmitting electrical energy therebetween; and means mounted on said tractor vehicle means and electrically connected to said circuit means for indicating and recording the contacts made between said metallic blade means and said command wires.

2. A minesweeping system according to claim 1 in which said sweep vehicle means includes hydrodynamic depressor means attached thereto for producing a downward force on said sweep vehicle and thereby overcoming the lift produced by towing said sweep vehicle.

3. A minesweeping system according to claim 1 in which said metallic blade means each comprise a plurality of metallic elements electrically insulated from each other for providing a plurality of command wire completed circuits therebetween.

4. A minesweeping system according to claim 3 in which said metallic blade means each comprise five metallic elements and four spacing layers of electrical insulation material therebetween, all laminated into an integral structure.

5. A minesweeping system according to claim 4 in which said metallic blade means are each sharpened to form a single cutting edge along the extent of one of said metallic elements with adjacent cutting faces including the exposed edges of the remaining metallic elements and insulating spacing layers lying in a plane for forming thereby a command wire severing element.

6. A minesweeping system according to claim 1 in which said circuit means comprises logic circuit means having an output only when each of said metallic blade means is in contact with an electrically conducting object.

7. A minesweeping system according to claim 6 in which said circuit means further comprises a time varying signal generator connected to said logic circuit means and driven thereby so as to vary its output in response to the length of time that said logic circuit means has an uninterrupted output signal.

8. A minesweeping system according to claim 7 in which said circuit means further comprises an electronic switch means connected to said time varying signal generator and responsive thereto for establishing a circuit connection between said blade means upon said time varying signal supplying a predetermined electrical signal.

9. A minesweeping signal according to claim 7 in which said indicating and recording means is electrically connected to said time varying signal generator means to indicate to operating personnel when said blade means simultaneously strike metallic conductors and to make a record thereof.

10. A minesweeping system according to claim 9 in which said indicating and recording means comprises a sound motion picture camera mounted on said tractor vehicle and oriented so as to photograph the shore features and connected so as to record a signal indicative of the output of said time varying signal generator means on a sound track of the motion picture film.

* * * * *